United States Patent [19]

Deatherage

[11] 4,288,133

[45] Sep. 8, 1981

[54] APPLIANCE CONTROL HOUSING AND CONSOLE CONSTRUCTION

[75] Inventor: Robert L. Deatherage, Newton, Iowa

[73] Assignee: The Maytag Company, Newton, Iowa

[21] Appl. No.: 130,836

[22] Filed: Mar. 17, 1980

[51] Int. Cl.[3] ..... A47B 81/00; B65D 6/00

[52] U.S. Cl. ..... 312/279; 312/257 A; 220/4 R; 52/718

[58] Field of Search ..... 312/279, 293, 214, 257 R, 312/257 SK, 257 A; 52/718; 220/4 R

[56] References Cited

U.S. PATENT DOCUMENTS

| | | | |
|---|---|---|---|
| 2,339,865 | 1/1944 | Larmour | 52/718 |
| 2,840,435 | 6/1958 | Campbell | 312/279 |
| 3,173,730 | 3/1965 | Collins | 312/279 |
| 3,253,874 | 5/1966 | Czech | 312/279 |
| 3,300,078 | 1/1967 | Stanback | 220/4 R |
| 3,881,794 | 5/1975 | Henning | 312/257 R |
| 4,003,613 | 1/1977 | Oakley | 312/257 A |
| 4,074,825 | 2/1978 | Smith | 220/4 R |
| 4,103,981 | 8/1978 | Donahue et al. | 312/257 A |
| 4,196,552 | 4/1980 | Bartlett | 52/718 |

*Primary Examiner*—Victor N. Sakran
*Attorney, Agent, or Firm*—Richard L. Ward

[57] ABSTRACT

An appliance is provided with a control housing secured to the cabinet top cover. The control housing includes a front opening which is closed by a control panel assembly engageable with the lower portion of the housing front and rearwardly pivotable for engagement with the top of the housing front. The control panel assembly includes a support panel and an overlying decorative panel which is biased toward the frontal surface of the support panel. This biasing maintains the rear of the face portion of the fascia panel in contact with the support panel. The control panel assembly ends are enclosed by a pair of rearwardly extending end caps which combine with the upper edge of the fascia panel to provide a continuous unbroken line at the top of the panel assembly and form a frame having a mitered corner appearance.

12 Claims, 6 Drawing Figures

APPLIANCE CONTROL HOUSING AND CONSOLE CONSTRUCTION

BACKGROUND OF THE INVENTION

This invention relates generally to the field of laundry and kitchen appliances and more particularly to an improved control housing therefore.

In household electrical appliances such as laundry appliances there is generally provided a control housing which is secured to the top cover of the appliance cabinet. This control housing is utilized for mounting various switches, timers, cycle selection switches and other controls essential to the operation of the appliance.

In the past, control panel assemblies have provided panels for support, nomenclature, etc., which are joined by mechanical fasteners or by adhesive bonding and which are then framed by a wrap-around decorative trim piece to provide a mitered corner and picture frame appearance.

More recently, control panels have been constructed with at least two panels joined by mechanical fasteners or by adhesive bonding and having a pair of decorative end caps for at least partially enclosing the exposed end portions of the panel assembly. In known constructions, the end caps, while being decorative, have not generally provided corners which give the appearance of a continuous frame construction as was previously achieved with the wrap-around decorative trim piece. The prior art end caps have included shoulders or other extensions which break the square corner and they do not provide a mitered appearance.

SUMMARY OF THE INVENTION

It is therefore an object of the instant invention to provide an improved control housing and control panel construction.

It is a further object of the instant invention to provide a control panel construction wherein the decorative frontmost panel is biased into a bowed engagement with the support panel thereby eliminating the need for mechanical fasteners or adhesive bonding therebetween.

It is a still further object of the instant invention to provide a corner construction having a mitered appearance unbroken by any outwardly extending shoulders.

Briefly, the instant invention achieves these objects in a control panel assembly for an appliance control housing having an open front. A support panel generally closes the open front of the control housing and includes a front portion and rearwardly projecting upper and lower shoulder portions. A decorative panel is provided which includes a face portion having a generally coextensively overlying relationship with the front portion of the support panel. The decorative panel also includes rearwardly projecting upper and lower flanges having an overlapping engagement with the shoulders of the support panel. The fabricated dimension between the support panel shoulder portions across the points of engagement with the decorative panel flanges being greater than the corresponding dimension between the decorative panel flanges to produce interference for springing apart the decorative panel flanges and bowing the decorative panel face portion into biased engagement with the front portion of the support panel. Locating members are associated with each of the panels and are cooperable for locating the decorative panel upon the support panel. A pair of end cap members are provided for at least partially enclosing the ends of the panel assembly. Each of the end cap members includes a rearwardly extending flange, a forwardly facing fascia section, and an inwardly and rearwardly extending tapered section. The tapered section of the end cap overlies an edge of the face portion of the decorative panel and is formed to mate with and provide a mitered appearance in cooperation with the decorative panel.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
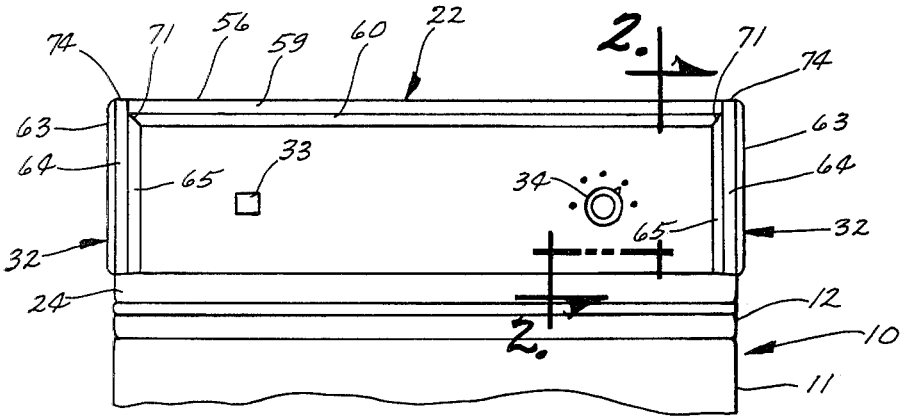
FIG. 1 is a partial front elevation view of an appliance utilizing the particular control housing and control panel structure of this invention.

Referring now to the drawings, there is shown in FIG. 1 the upper portion of a home electrical appliance 10 such as a clothes washing or drying machine. The appliance 10 includes a generally rectangular, wrap-around outer cabinet 11 and a horizontal top cover 12.

Figure 2:
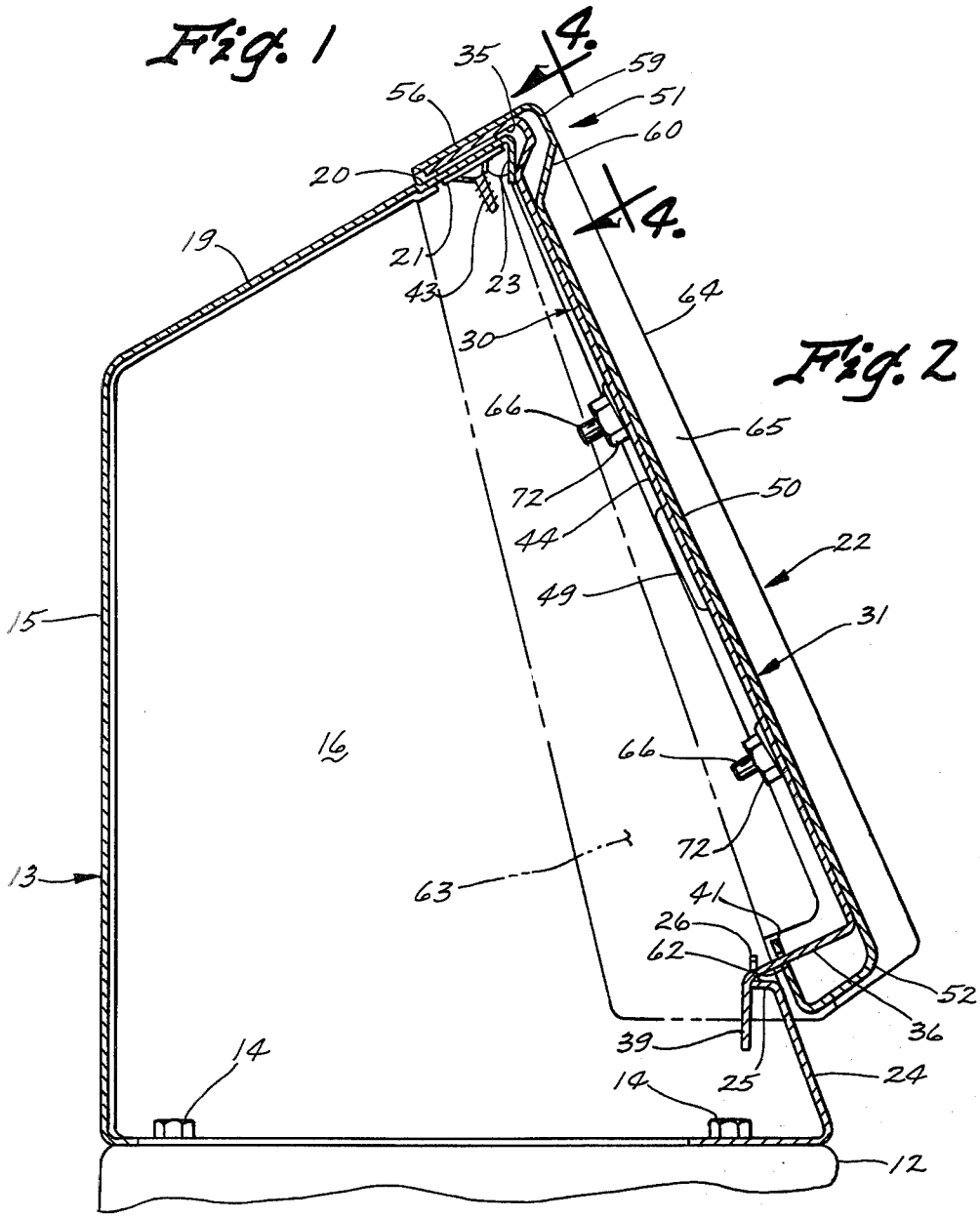
FIG. 2 is a sectional view through the control housing and panel assembly generally along lines 2—2 of FIG. 1.
Figure 3:
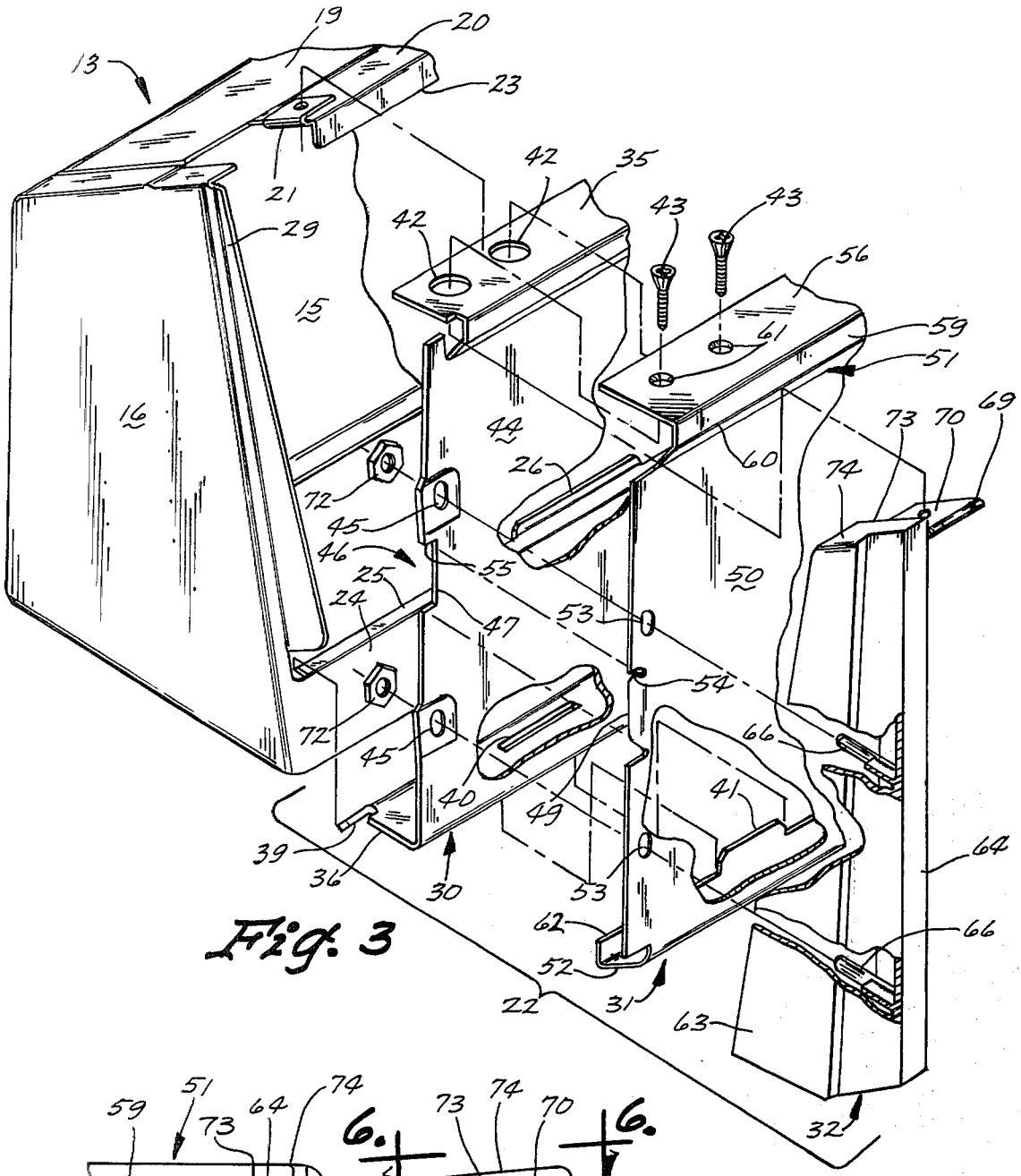
FIG. 3 is a fragmentary exploded view of a corner of the control housing and panel assembly showing the assembly of various component parts.

The top cover 12 mounts, at its rearward extremity, an upwardly projecting, horizontally elongated control housing 13. As best shown in FIG. 2, the control housing 13 is secured to the top cover 12 by a plurality of thread forming fasteners 14 which tap into pilot holes in the mounting surface of the top cover 12. The control housing 13 is formed from sheet metal and includes substantially vertical rear and side walls 15 and 16 as shown in FIGS. 2 and 3. A top wall 19 extends angularly upward and forward from the top of the rear wall 15. As best shown in FIG. 3, the front edge 20 of the top wall 15 is downwardly embossed by at least a metal thickness to receive a spring clip fastener 21 for use in securing the control panel assembly 22 to the control housing 13. The extreme forward portion of the downwardly embossed area is downwardly turned to form a flange 23 as shown in FIGS. 2 and 3. Both outside corners of the downwardly embossed area are cut away for receiving the control panel assembly 22 as will be discussed further herein.

The front of the control housing 13 is generally open. A lower front wall 24 joins the two side walls 16 and extends upwardly and rearwardly generally toward the front edge 20 of the top wall 19 for a distance equal to about one-tenth the total frontal area with the remaining nine-tenths of the area being open. As best shown in FIG. 3, the lower front wall 24 includes a rearwardly formed lip 25 extending along its entire horizontally elongated width and having a plurality of horizontally spaced apart upwardly projecting tabs 26 located along that width. The front edges 29 of the two side walls 16 are rearwardly sloped from bottom to top to match the inclination of the front wall 24.

The frontal opening of the control housing 13 is closed by a control panel assembly 22 comprising a support panel 30, a decorative panel 31 and a pair of end caps 32.

The support panel 30 is formed from sheet metal and is generally horizontally elongated to cover the frontal opening of the control housing 13. The support panel 30 is generally utilized for mounting various switches 33, a timer 34 and other elements necessary for control of the appliance 10. The support panel 30 includes upper and lower rearwardly projecting shoulder portions 35 and 36 which are engageable with the front edge 20 of the control housing top wall 19 and the lip 25 of the control housing lower front wall 24, respectively. The lower shoulder portion 36 of the support panel 30 includes a plurality of rearwardly and downwardly extending members 39 which will straddle the upwardly projecting tabs 26 of the control housing lower front wall lip 25 providing an interconnect for pivoting the support panel 30 about the lip 25. The support panel 30 lower shoulder portion 36 also includes, as shown in FIGS. 2 and 3, a plurality of horizontally spaced apart slots 40 operable for engaging with tab portions 41 of the decorative panel 31 as will be further discussed herein. The upper shoulder portion 35 of the support panel 30 includes a pair of clearance holes 42 at each end for passage of machine screws 43 used in securing the end caps 32 to the control panel assembly 22 and the control panel assembly 22 to the control housing 13. Each side of the front portion 44 of the support panel 30 includes a pair of slots 45, vertically elongated with respect to the front portion 44 of the support panel 30, for use in the assembly of the end caps 32 to the control panel assembly 22. Spaced between these slots 45 is an edge cutout 46 which engages with a rearwardly turned tab member 49 of the decorative panel 31.

The decorative panel 31 is also horizontally elongated and generally covers the support panel 30. The panel 31 is both decorative and informative in that the operating information associated with the various control elements is placed on the surface facing the appliance user. The decorative panel 31 is formed from a unitary sheet material and includes a forwardly facing body portion 50, an upper frame portion 51 and a lower flange portion 52.

The body portion 50 of the decorative panel 31 includes, at each end, a pair of vertically elongated slots 53 which are aligned with the vertically elongated slots 45 in the support panel 30. The rearwardly turned tab member 49 on each end between the vertical slots 53 is aligned with and is engageable with the cutouts 46 in the ends of the support panel 30. The support panel cutouts 46 and the fascia panel tabs 49 are designed so that the upper portion 54 of the tab member 49 engages with the upper portion 55 of the support panel cutout 46 to limit vertical movement of the decorative panel 31 with respect to the support panel 30 and thus vertically align and orient the decorative panel 31 upon the support panel 30.

The upper frame portion 51 of the decorative panel 31 has a rearwardly extending flange 56, a forwardly facing fascia section 59 connected to the flange 56 and a tapered section 60 extending downwardly and rearwardly from the fascia section 59 to the body portion 50. Each end of the rearwardly extending flange 56 includes a pair of countersunk holes 61 for receiving the head portions of the machine screws 43.

The lower flange portion 52 of the decorative panel 31 projects downwardly and rearwardly from the body portion 50 and includes an upwardly facing edge 62 substantially parallel to the body portion 50. The parallel upwardly facing edge 62 has a plurality of tabs 41 which interlock with the horizontally spaced apart slots 40 in the lower shoulder portion 36 of the support panel 30.

As previously mentioned, each end of the assembly of support and decorative panels 30 and 31 is decoratively covered by an end cap 32. These end caps 32 each include a rearwardly extending outside flange 63, a forwardly facing fascia section 64 and an inwardly and rearwardly extending tapered section 65.

As best shown in FIG. 3, the interior of the molded thermoplastic or die cast end caps 32 includes a pair of rearwardly extending studs 66 which are aligned with the vertically elongated slots 45 and 53 in the support panel 30 and the decorative panel 31. The upper extremity of each end cap 32 includes a narrow recessed ledge 69 for mounting a spring clip fastener 70 which is used to secure the end cap 32 to the top of the control panel assembly 22.

Figure 4:
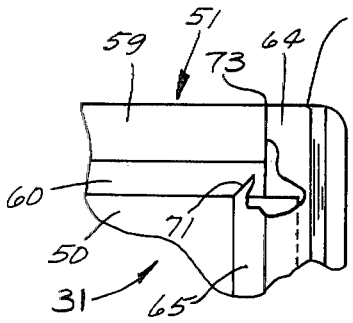
FIG. 4 is a view of an upper corner of the panel and end cap assembly showing the mitered corner construction.
Figure 5:
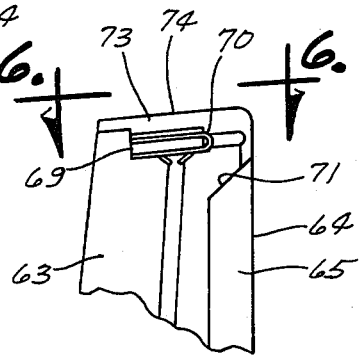
FIG. 5 is a view of the upper portion of an end cap showing in greater detail the corner construction.
Figure 6:
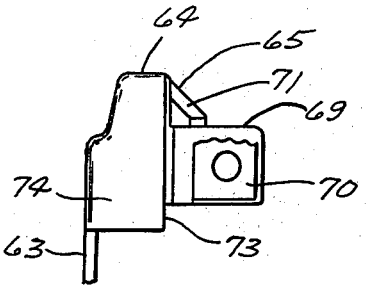
FIG. 6 is a view of the top of the end cap of FIG. 5 taken generally along lines 6—6.

The inwardly and rearwardly extending tapered section 65 of each end cap 32 includes, as shown in FIGS. 4, 5 and 6, a mitered upper edge 71 which is formed for cooperatively mating with the tapered section 60 of the frame portion 51 of the decorative panel 31 to provide a mitered appearance.

The support panel 30, decorative panel 31 and end caps 32 are assembled to provide a unitary control panel assembly 22 which is readily removed from the control housing 13 as a unit for quickly and efficiently servicing the various components mounted to the rear of the support panel 30 and contained within the control housing 13. After switches 33 and/or other components have been secured to the support panel 30 the decorative panel 31 is assembled thereto. In assembling the decorative panel 31 to the support panel 30 the tabs 41 associated with the lower flange portion 52 of the decorative panel 31 are first inserted into the slots 40 in the lower shoulder portion 36 of the support panel 30. The decorative panel 31 is then pivoted about the interlocking tabs 41 and slots 40 and the upper rearwardly extending flange 56 is rotated into position over the upper shoulder portion 35 of the support panel 30.

The assembly of the decorative panel 31 to the support panel 30 is designed so that the fabricated dimension between the upper and lower shoulder portions 35 and 36 of the support panel 30 is somewhat greater than the fabricated dimension between the upper and lower flanges 56 and 52 of the decorative panel 31. The lower flange 52 of the decorative panel 31 forms a spring member that can be biased in the vertical direction after the tabs 41 of the decorative panel 31 have been inserted into the slots 40 of the lower shoulder portion 36 of the support panel 30. Because of the spring member, the decorative panel 31 can be sprung or biased somewhat to allow the upper flange 56 of the decorative panel 31 to engage the upper shoulder portion 35 of the support panel 30 in an overlapping interference fit. The springing apart of the decorative panel 31 flanges 52 and 56 will effect a bowing of the rear of the body portion 50 toward and into biased engagement with the front portion 44 of the support panel 30 and engagement of the upper portion 54 of the rearwardly turned tabs 49 of the decorative panel 31 with the upper portion 55 of the edge cutouts 46 of the support panel 30 to vertically align the decorative panel 31 upon the front portion of the support panel 30. Horizontal alignment of the decorative panel 31 upon the support panel 30 is accomplished by the engagement of the decorative panel tabs 49 with the sides 47 of the support panel cutouts 46. The bowing of the decorative panel 31 body portion 50 maintains biased engagement of the rear of the decorative panel body portion 50 with the front portion 44 of the support panel 30 and precludes the use of adhesives or mechanical fasteners to bond the panels 30 and 31 together for preventing rattling or vibration of one panel against the other during operation of the appliance 10.

Once the support and decorative panels 30 and 31 have been joined, the two end caps 32 are attached to the panel assembly. As will be noted in the drawings, and especially in FIG. 3, the upper corners of the two panels 30 and 31 are notched or cut away. This notching allows the recessed ledge 69 at the upper portion of the end caps 32 to fit under the upper shoulder portion 35 of the support panel 30. After the recessed ledge 69 of the end cap 32 has been located with respect to the panels 30 and 31, the end cap 32 can be rotated toward the panel assembly with the pair of studs 66 extending through the pair of aligned slots 45 and 53 in the support panel 30 and decorative panel 31. A pair of self-threading nuts 72 are turned onto the studs 66 for securing each of the end caps 32 to the panel assembly. A machine screw 43 is inserted through the outermost countersunk hole 61 in the decorative panel 31 upper flange 56, through the aligned clearance hole 42 in the support panel 30 upper shoulder portion 35 and into engagement with the spring clip fastener 70 attached to the recessed ledge 69 of the end cap 32 to secure the upper edge of the end cap 32 in alignment with the top of the panel assembly.

The completed control panel assembly 22 is now ready to be attached to the control housing 13 to close the open front. To accomplish this attachment, the rearwardly and downwardly extending members 39 of the lower shoulder portion 36 of the support panel 30 are placed in a posture for straddling the upwardly projecting tabs 26 of the lower front wall lip 25. The control panel assembly 22 is then pivoted rearwardly about the lower front wall lip 25 and into engagement with the front edge 20 of the top wall 19. A second machine screw 43 is then driven through the innermost countersunk hole 61 in the decorative panel 31 upper flange 56 and the aligned clearance hole 42 in the support panel 30 upper shoulder portion 35 and into engagement with the spring clip fastener 21 associated with the top wall 19 of the control housing 13. Thus, by simply removing a machine screw 43 from each end the control panel assembly 22 can be pivoted forward as a unit for servicing or replacement.

As shown in FIGS. 1 and 4, the control panel assembly 22 provides an upper corner construction unbroken by shoulders extending outwardly from the substantially square outline of the frame corner. As indicated in FIGS. 2 and 4, the fascia 64 of the end cap 32 and the fascia section 59 of the decorative panel 31 are disposed in a common plane and in a butting arrangement. The tapered section 65 of the end cap 32 overlies the end of the body portion 50 of the decorative panel 31 and cooperatively mates with the tapered section 60 of the upper frame portion 51 of the decorative panel 31 to provide a mitered corner appearance. The fragmentary section of FIG. 4 shows the end of the body portion 50 under the tapered section 65 of the end cap 32. FIG. 4 also shows the notched corner of the decorative panel 31 with the end of the decorative panel 31 butting against the surface 73 formed at substantially a right angle to the end cap top surface 74. Thus, a unitary control panel assembly 22 is provided wherein the end cap top surface 74 is always even or slightly above the generally horizontal plane of the top of the control panel assembly 22.

It is therefore seen that the instant invention provides an improved, unique, control panel construction. The invention provides for the assembly of the support and decorative panels 30 and 31 in a manner which biases the decorative panel 31 toward the support panel 30 for maintaining surface contact of the front 44 of the support panel 30 and the rear of the body portion 50 of the decorative panel 31. The addition of decorative end caps 32 to the panel assembly provides a control panel assembly 22 having a corner construction with no broken or extending lines and shoulders and a mitered frame appearance.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. A control panel assembly for an appliance control housing having an open front, the combination comprising: a relatively rigid support panel for generally closing said open front and including a front portion and rearwardly projecting upper and lower shoulder portions; a relatively less rigid decorative panel including a face portion having a generally coextensively overlying relationship with the front portion of said support panel and rearwardly projecting upper and lower flanges having an overlapping engagement with the shoulders of said support panel, the fabricated dimension between said support panel shoulder portions across the points of engagement with said decorative panel flanges being greater than the corresponding dimension between said decorative panel flanges to produce interference for removably retaining said decorative panel on said support panel and for springing apart said decorative panel flanges and bowing said decorative panel face portion into biased engagement with the front portion of said support panel; means associated with each of said panels and cooperable for locating said decorative panel upon and interlocking said decorative panel to said support panel.

2. A control panel assembly as defined in claim 1 wherein said last named means includes means associated with one of said shoulders and one of said flanges for providing an interlocking pivotal connection between said support panel and said decorative panel to facilitate assembly and disassembly of said decorative panel.

3. A control panel assembly for an appliance control housing having an open front, the combination comprising: a relatively rigid support panel for generally closing said open front and including a front portion and rearwardly projecting upper and lower shoulder portions; a relatively less rigid decorative panel including a face portion and rearwardly projecting upper and lower flanges; means for providing an interlocking pivotal connection between one of said flanges and the corresponding shoulder portion of said support panel, said decorative panel being pivotable about said interlocking connection into engagement with said support panel for an overlapping interference between said flanges and the shoulder portions of said support panel, the fabricated dimension between said support panel shoulder portions across the points of engagement with said decorative panel flanges being greater than the corresponding dimension between said decorative panel flanges to produce said interference for removably retaining said decorative panel on said support panel and for springing apart said decorative panel flanges and bowing the face portion of said decorative panel into at least partial engagement with the front portion of said support panel, said decorative panel face portion having a generally coextensively overlying relationship with the front portion of said support panel in the assembled posture; and locating means associated with each of said panels and cooperable for locating said decorative panel upon said support panel.

4. A control panel assembly as defined in claim 3 wherein said lower shoulder portion of said support panel includes means for engaging with a lower portion of said control housing for rotating said control panel assembly to thereby close said open front.

5. A control panel as defined in claim 3 wherein said means providing an interlocking pivotal connection between said panels includes at least one slot associated with said lower shoulder portion of said support panel and at least one mating tab associated with said lower flange of said decorative panel.

6. A control panel assembly as defined in claim 3 wherein said locating means includes at least one cutout associated with one of said panels and at least one cooperative tab associated with the other of said panels.

7. A control panel assembly for an appliance control housing having an open front, the combination comprising: a horizontally elongated relatively rigid support panel for generally closing said open front and including a front portion and rearwardly projecting upper and lower shoulder portions engageable with upper and lower portions of said housing; a horizontally elongated relatively less rigid decorative panel including a decorative face portion and rearwardly projecting upper and lower flanges; means for providing an interlocking pivotal connection between one of said flanges and the corresponding shoulder portion of said support panel, said decorative panel being pivotable about said interlocking connection into engagement with said support panel for an overlapping interference between said flanges and the shoulder portions of said support panel, the fabricated dimension between said support panel shoulder portions across the points of engagement with said decorative panel flanges being greater than the corresponding dimension between said decorative panel flanges to produce said interference for removably retaining said decorative panel on said support panel and for springing apart said decorative panel flanges and bowing the face portion of said decorative panel into at least partial engagement with the front portion of said support panel, said decorative panel face portion having a generally coextensively overlying relationship with the front portion of said support panel in the assembled posture; and a cooperative slot and tab arrangement associated with said support and decorative panels for both horizontally and vertically locating the face of said decorative panel upon the front of said support panel as said decorative panel is sprung and pivoted into engagement with said support panel.

8. A control panel assembly as defined in claim 7 wherein said means for providing an interlocking pivotal connection includes at least one slot associated with said support panel lower shoulder portion and at least one mating tab associated with said lower flange of said decorative panel.

9. A control panel assembly as defined in claim 7 wherein said panel assembly further includes a pair of end cap members generally overlying the ends of said decorative panel face portion for at least partially enclosing the ends of said panel assembly.

10. A control panel for an appliance control housing having an open front, the combination comprising: horizontally elongated panel means for generally closing said open front, said panel means including a unitary member of sheet material and comprising a generally forwardly facing body portion and an upper frame portion, said upper frame portion including a rearwardly extending flange, a generally forwardly facing fascia section connected to said flange, and a tapered section extending downwardly and rearwardly from said fascia section to said body portion; a pair of end cap members for at least partially enclosing the ends of said panel means, each of said end cap members including a rearwardly extending outside flange, a forwardly facing fascia section, and an inwardly and rearwardly extending tapered section, the tapered section of said end cap overlying the end of the body portion of said panel means and having an upper edge formed to mate with and provide a mitered appearance in cooperation with the tapered section of said panel means frame portion, said end cap fascia section and the fascia section of said panel means frame portion being disposed in a common plane and having a butting relationship, said end cap having a top surface formed for alignment with the flange of said panel means frame portion; and means for connecting said end caps to said panel means for maintaining alignment of the flange and fascia section of said panel means frame portion with the top surface and fascia section of said end caps respectively whereby a corner construction unbroken by shoulders extending outwardly from the square outline of the frame corner is achieved.

11. Panel structure as defined in claim 10 wherein said connecting means includes fastener means associated with said end caps and extending through said panel means for securing said end caps to said panel means.

12. Panel structure as defined in claim 10 wherein said end cap members each include a ledge recessed from said top surface for receiving said panel flange and for aligning said flange with said end cap top surface.

* * * * *